US010328447B1

(12) United States Patent
Vandenbergh et al.

(10) Patent No.: US 10,328,447 B1
(45) Date of Patent: Jun. 25, 2019

(54) SPRAY DISPENSER FOR LIQUID DISPENSING PRODUCT HAVING A NOZZLE GUARD

(71) Applicant: The Procter & Gamble Company, Cincinnati, OH (US)

(72) Inventors: Pieter Paul Dirk Jenny Maria Vandenbergh, St. Martens Latem (BE); Richard Christopher Hagee, Cincinnati, OH (US); Mark Armstrong, Islington London (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/883,507

(22) Filed: Jan. 30, 2018

(51) Int. Cl.
*B05B 15/16* (2018.01)
*B05B 11/00* (2006.01)

(52) U.S. Cl.
CPC ..... *B05B 15/16* (2018.02); *B05B 11/3045* (2013.01); *B05B 11/3057* (2013.01)

(58) Field of Classification Search
CPC .. B05B 15/16; B05B 11/3045; B05B 11/3057
USPC ..... 222/383.1
See application file for complete search history.

(56) References Cited

U.S. PATENT DOCUMENTS 5,088,628 A * 2/1992 Knickerbocker ... B05B 11/0029 215/221
5,477,989 A * 12/1995 Maas ..... B05B 11/0005 215/216
5,687,880 A * 11/1997 Maas ..... B05B 11/0029 222/153.14
5,695,095 A 12/1997 Hildebrand
5,775,432 A 7/1998 Burns et al.
6,616,975 B1 9/2003 Reizian
6,886,718 B2 5/2005 Foster et al.
6,938,804 B2 9/2005 Chen
7,017,833 B2 * 3/2006 Foster ..... B05B 1/12 222/383.1
7,191,920 B2 3/2007 Boll et al.
8,016,167 B2 9/2011 Tomkins et al.
(Continued)

FOREIGN PATENT DOCUMENTS

CN 201760370 U 3/2011
EP 0701950 A2 3/1996
(Continued)

*Primary Examiner* — Benjamin R Shaw
(74) *Attorney, Agent, or Firm* — Gary J. Foose

(57) ABSTRACT

A liquid dispensing product having: a spray dispenser having a nozzle with a guard of the nozzle and a liquid composition, the spray dispenser configured to spray the composition. The spray dispenser having a shroud housing a pump, the shroud having a shroud top surface, a shroud bottom edge opposing the shroud top surface and shroud walls connecting the shroud top surface to the shroud bottom edge; a rotatable nozzle cover housing a discharge nozzle, the discharge nozzle in fluid communication with the pump; a trigger operatively engaged with the pump; and a guard proximate the nozzle cover, the guard inhibiting contact by an outside structure or force with the nozzle cover from at least one direction. The guard is not in direct contact with the nozzle. The liquid composition having from about 5% to about 15%, by weight of the composition, of a surfactant system.

18 Claims, 10 Drawing Sheets

(56) References Cited

U.S. PATENT DOCUMENTS

| | | | | |
|---|---|---|---|---|
| 8,430,272 | B2 | 4/2013 | Porter | |
| 8,757,447 | B2 | 6/2014 | Gill et al. | |
| 2004/0217134 | A1* | 11/2004 | Foster | B05B 11/3011 222/383.1 |
| 2005/0092778 | A1* | 5/2005 | Bistolfi | B05B 1/341 222/383.1 |
| 2005/0173560 | A1 | 8/2005 | Bitowft | |
| 2006/0115447 | A1* | 6/2006 | Tsotsoros | A61K 8/585 424/70.122 |
| 2007/0181606 | A1 | 8/2007 | Foster | |
| 2007/0295757 | A1* | 12/2007 | Foster | B05B 11/3011 222/340 |
| 2008/0230563 | A1* | 9/2008 | Maas | B05B 11/0062 222/383.1 |
| 2008/0308655 | A1* | 12/2008 | Yuan | B05B 11/0029 239/526 |
| 2010/0018999 | A1* | 1/2010 | Maas | B05B 11/0008 222/383.1 |
| 2012/0279992 | A1 | 11/2012 | Wilder | |
| 2014/0239018 | A1* | 8/2014 | Maas | B05B 11/0008 222/383.1 |
| 2014/0239096 | A1 | 8/2014 | Jacques et al. | |
| 2015/0090736 | A1 | 4/2015 | Erickson et al. | |
| 2015/0252302 | A1* | 9/2015 | Rieth | C11D 3/2072 514/772 |

FOREIGN PATENT DOCUMENTS

| | | | |
|---|---|---|---|
| EP | 1007142 | A4 | 6/2000 |
| EP | 1132144 | A1 | 9/2001 |
| EP | 1188487 | A1 | 3/2002 |
| EP | 1501576 | B1 | 12/2009 |
| EP | 2162229 | A1 | 3/2010 |
| EP | 1999061 | B1 | 11/2011 |
| EP | 1917205 | B1 | 12/2011 |
| EP | 2029288 | B1 | 5/2013 |
| EP | 2344280 | B1 | 1/2016 |
| GB | 2303410 | A | 2/1997 |
| JP | 2014233679 | A | 12/2014 |
| WO | WO2008/147679 | A1 | 12/2008 |
| WO | WO2010041411 | A1 | 4/2010 |
| WO | WO2013096809 | A3 | 6/2015 |

* cited by examiner

SPRAY DISPENSER FOR LIQUID DISPENSING PRODUCT HAVING A NOZZLE GUARD

FIELD OF THE INVENTION

Spray dispensers having nozzles for dispensing of liquid products and guard components inhibiting contact by an outside structure or force with the nozzle.

BACKGROUND OF THE INVENTION

Liquid products, particularly household and fabric care compositions such as dishwashing soap, hand soap, and surface cleaners, are a popular choice among consumers. Generally, such liquids are sold within containers attached to trigger actuated spray dispensers and are called liquid dispensing products. Trigger spray dispensers attached to containers allow for the liquid within the container to flow from within the container to a targeted surface with minimal physical exertion by the user. Traditional trigger spray dispensers may have a spray nozzle attached to a shroud housing a pump, and a trigger having for example, a trigger lever, underneath the spray nozzle. The shroud is then attached to a container holding the liquid. The trigger lever is typically found beneath the spray nozzle because as a user grips the product, the user can hold the entire product and actuate the trigger spray dispenser with only one hand. A user will typically place their hand around the neck of the container with the user's index finger and possibly middle finger on the trigger lever and the user's thumb, ring finger, and pinky wrapped underneath the trigger lever. In this configuration, the user may easily point the spray dispenser towards the targeted surface the user wishes to spray and press on the trigger with the user's fingers.

Manufacturers want to ensure that trigger spray dispensers are convenient to operate without too much force being necessary to actuate the spray dispenser and that there is an even flow of spray through the nozzle to provide for a pleasant spraying experience. Manufacturers do not want for the nozzle to be inadvertently misaligned or knocked off so as to provide an uneven spray, or even not allow for liquid to come out at all. The issue of nozzle misalignment can often occur during shipping, storage, display on the shelf, and/or by the user in using the spray dispenser. Manufacturers also want for the spray dispenser to maintain its product integrity during shipping, storage, and/or display on a store shelf.

One way manufacturers have attempted to solve the problem of accidental misalignment of the nozzle is by placing a separate nozzle cover piece to house the nozzle. The nozzle cover is often physically connected, even if only by small threads, to the nozzle in order to be rotatable with the nozzle for ease of use, should the nozzle and/or nozzle cover be rotatable. However, as the nozzle cover is physically connected to the nozzle, when a physical force is exerted upon it, the nozzle cover receives much of the energy transferred from the object or person exerting the force, but some is still transferred to the nozzle. Even small forces can be enough to move a delicate nozzle structure and pathway out of alignment and resulting in uneven or no liquid to be dispensed.

Another way manufacturers have attempted to solve this problem of accidental misalignment of the nozzle is by providing a spray dispenser cap that is separate from the spray dispenser and is placed over the shroud and nozzle when the spray dispenser is not in use. Although spray dispenser caps can provide protection from physical force to the nozzle when the spray dispenser is not in use, spray dispenser caps only work when a user remembers to place the spray dispenser cap back on to the spray dispenser. As such, this is only a temporary solution to protect the nozzle. Spray dispenser caps do not protect the nozzle from when the user is using the spray dispenser and accidentally bumps their finger into the nozzle with enough force to cause misalignment. In addition, spray dispenser caps can be costly for manufacturers to produce and attach the cap to the spray dispenser as a second piece.

In view of the above, there is a continuing unaddressed need for a spray dispenser for liquid products having a nozzle guard to protect the nozzle from misalignment and method of using such spray dispenser having a nozzle guard, where the nozzle guard is not physically connected to the nozzle so as to not allow any force to be transferred to the nozzle and where the nozzle guard is a permanent attachment to the spray dispenser such that the nozzle guard is a permanent component always providing protection to the nozzle.

SUMMARY OF THE INVENTION

A liquid dispensing product comprising a spray dispenser and a liquid composition, wherein the spray dispenser is configured to spray the composition. The spray dispenser comprising a shroud housing a pump, wherein the shroud comprises a shroud top surface, a shroud bottom edge opposing the shroud top surface, and shroud walls connecting the shroud top surface to the shroud bottom edge; a rotatable nozzle cover housing a discharge nozzle, wherein the discharge nozzle is in fluid communication with the pump; a trigger operatively engaged with the pump; and a guard proximate the nozzle cover, wherein the guard inhibits contact by an outside structure or force with the nozzle cover from at least one direction and wherein the guard is not in direct contact with the nozzle. The liquid composition comprising from about 5% to about 15%, by weight of the composition, of a surfactant system. Further, an assembly of the liquid dispensing products. Further, a method of shipping one or more of the liquid dispensing products comprising the step of facilitating the transfer of one or more of the liquid dispensing products from a first geographical address to a second geographical address.

DETAILED DESCRIPTION OF THE INVENTION

Figure 1:
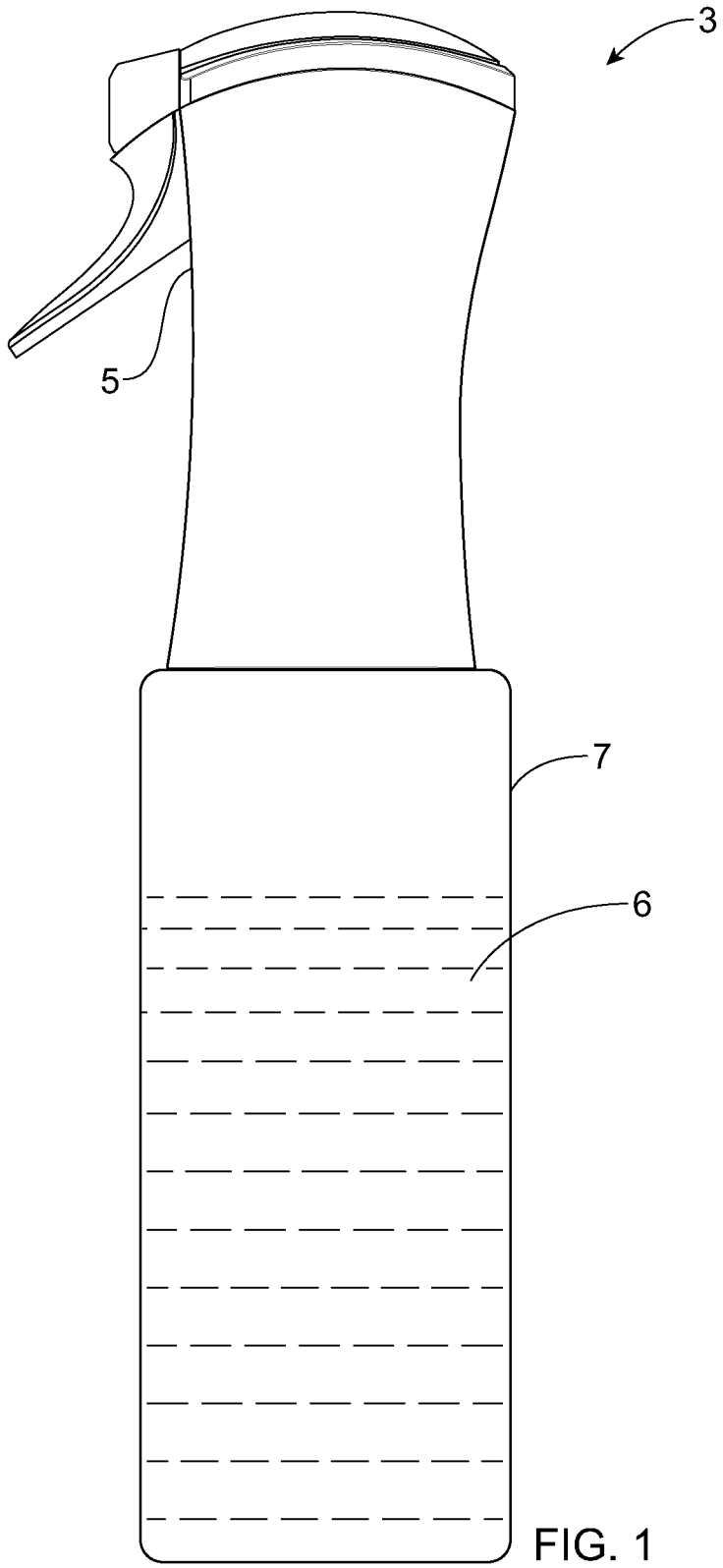
FIG. 1 shows a side view of a liquid dispensing product having a spray dispenser and a liquid composition within a container attached to the spray dispenser.
Figure 2:
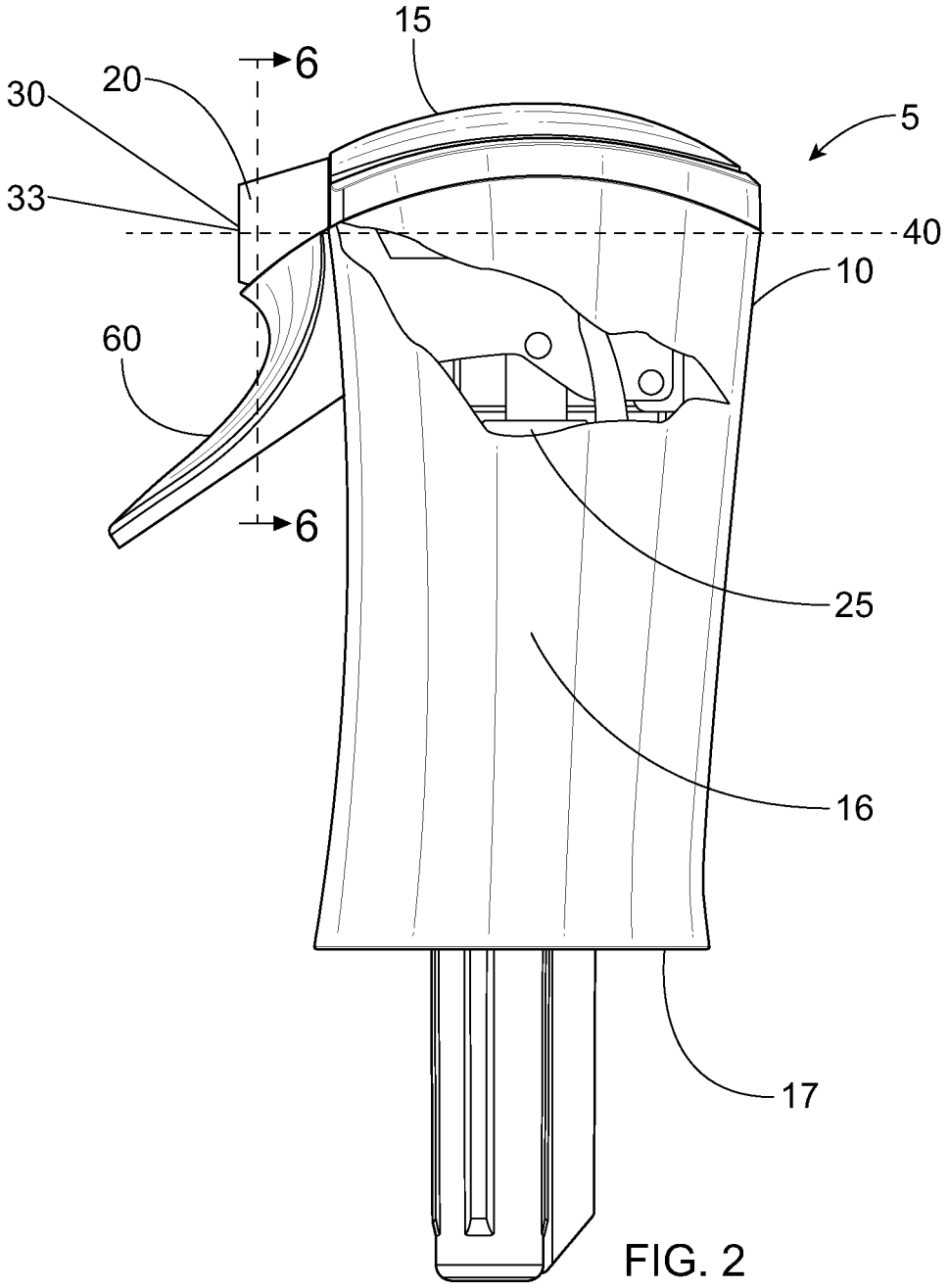
FIG. 2 shows a side view having a cutout of a spray dispenser.

FIG. 1 shows a side view of a liquid dispensing product 3 comprising a spray dispenser 5 and a liquid composition 6 within a container 7 attached to the spray dispenser 5. FIG. 2 shows the side view of a spray dispenser 5. The spray dispenser 5 may comprise a shroud 10 housing a pump 25. A portion of the shroud 10 in FIG. 2 is partially cut away to show a pump 25. The shroud 10 has a shroud top surface 15, a shroud bottom edge 17 opposing the shroud top surface 15, and shroud walls 16 connecting the shroud top surface 15 to the shroud bottom edge 17. The spray dispenser 5 may comprise a rotatable nozzle cover 20 housing a discharge nozzle 30. The nozzle 30 may comprise a nozzle orifice 33 where liquid may ultimately exit the spray dispenser 5. The nozzle orifice 33 may be an opening in which the liquid ultimately exits the spray dispenser 5 as it moves through the nozzle 30 and nozzle flow pathway. The nozzle orifice 33 may be the opening at the end of the nozzle flow pathway that is further in distance from the pump 25 or further in distance from the container 7 than the other end of the nozzle flow pathway. The nozzle cover 20 may be rotatable about a central axis 40. The nozzle cover 20 may be rotatable about a central axis 40 thereof between a discharge unlocked position and a discharge locked position, or among different points to provide a spectrum of quantity of liquid composition 6 flow. The discharge nozzle 30 may extend from the shroud 10. The discharge nozzle 30 may be in fluid communication with the pump 25. The spray dispenser 5 may comprise a trigger 60. The trigger 60 may be operatively engaged with the pump 25. The spray dispenser 5 may comprise a nozzle guard 34 proximate the nozzle cover 20. The guard 34 may inhibit contact by an outside structure or force with the nozzle cover 20 from at least one direction and the guard 34 is not in direct contact with the nozzle 30.

Figure 3:
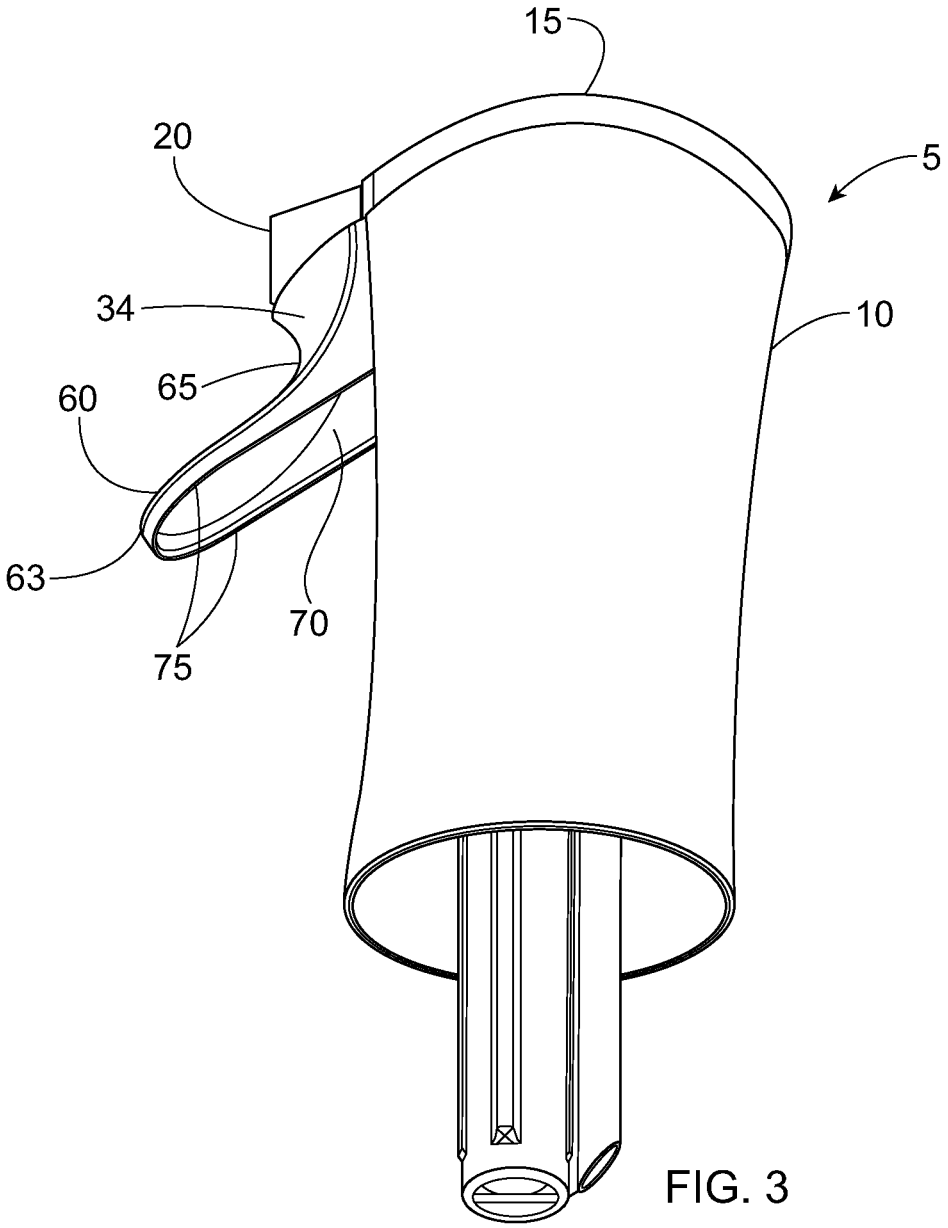
FIG. 3 shows a perspective view of a spray dispenser.

FIG. 3 shows a perspective view of a spray dispenser 5. The spray dispenser 5 may comprise a trigger 60 operatively engaged with the pump 25 (not shown). The trigger 60 may have a trigger front surface 65. The trigger front surface 65 faces away from the shroud 10. The trigger 60 may have an opposing trigger back surface 70. The trigger 60 may have a pair of opposing trigger lateral edges 75. The trigger 60 may comprise a movable part 63 operatively engaged with a means of releasing the movable part (not shown).

Figure 4:
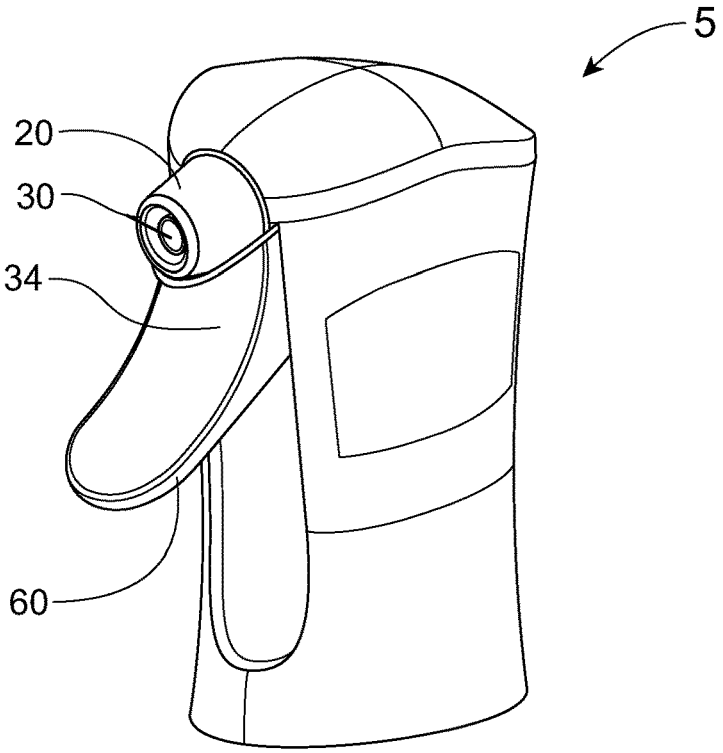
FIG. 4 shows a perspective view of a spray dispenser having a nozzle guard.

FIG. 4 shows a perspective view of a spray dispenser 5 having a nozzle guard 34. The spray dispenser 5 may comprise a nozzle guard 34 proximate the nozzle cover 20. The guard 34 may inhibit contact by an outside structure or force with the nozzle cover 20. The guard 34 is not in direct contact with the nozzle 30. The guard 34 may be beneath the nozzle cover 20. The guard 34 may be at least partially between the nozzle cover 20 and the trigger 60.

Figure 5:
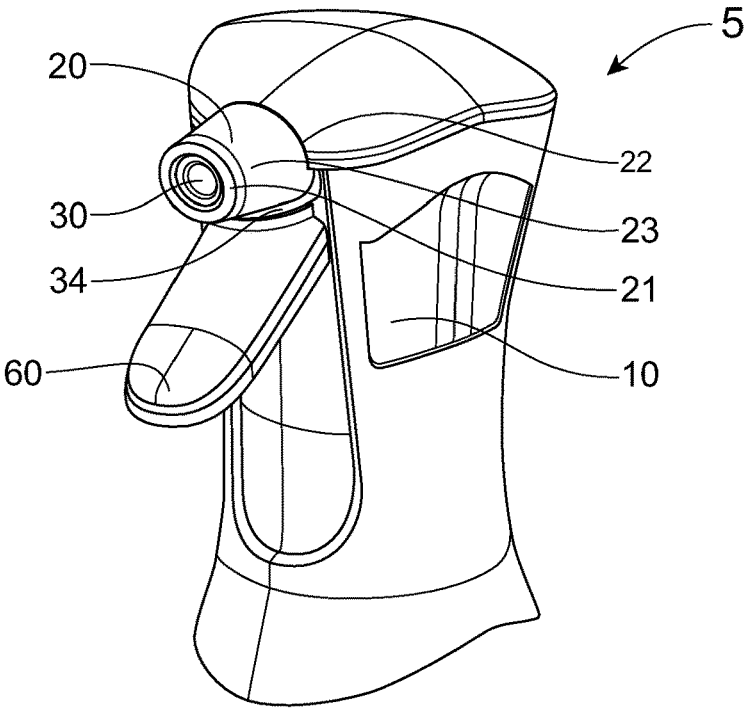
FIG. 5 shows a perspective view of a spray dispenser having a nozzle guard.

FIG. 5 shows a perspective view of the spray dispenser 5 having a nozzle guard 34. The guard 34 may inhibit contact by an outside structure or force with the nozzle cover 20 from at least two directions, such as a first direction characterized by moving towards the underside of the nozzle cover 20 in an upwards direction and a second direction characterized by moving towards the side of the nozzle cover 20 in a sideways direction generally parallel to the Earth. The guard 34 may inhibit contact by an outside structure or force with the nozzle cover 20 from at least three directions, such as by the first and second directions described above, as well as a third direction opposite the second direction. Although not pictured, it can be contemplated that such directions are not so limited. A fourth direction characterized as opposing the first direction coming towards the nozzle cover 20 in a downwards direction can be contemplated. Any such direction or degree towards the nozzle cover 20 may be contemplated. As also shown in FIG. 5, at least a part of the nozzle cover 20 may be between the guard 34 and the shroud 10 (more easily seen in FIG. 6). As further shown, the nozzle cover 20 may have a nozzle cover front edge 21 and a nozzle cover back edge 22 opposing the nozzle cover front edge 21 and facing the shroud 10. The nozzle cover 20 may have nozzle cover walls 23 connecting the nozzle cover front edge 21 to the nozzle cover back edge 22. The nozzle cover back edge 22 may be proximate the shroud 10. The nozzle cover back edge 22 may be connected to the shroud 10. As shown, the guard 34 may at least partially surround the nozzle cover walls 23. The nozzle cover 20 may be of a slightly conical shape. As such, the guard 34 may take any shape to conform to the shape of the nozzle cover 20, here, a conical shape, to maintain inhibition from an outside force and to maintain the nozzle cover 20 from being able to rotate.

Figure 6:
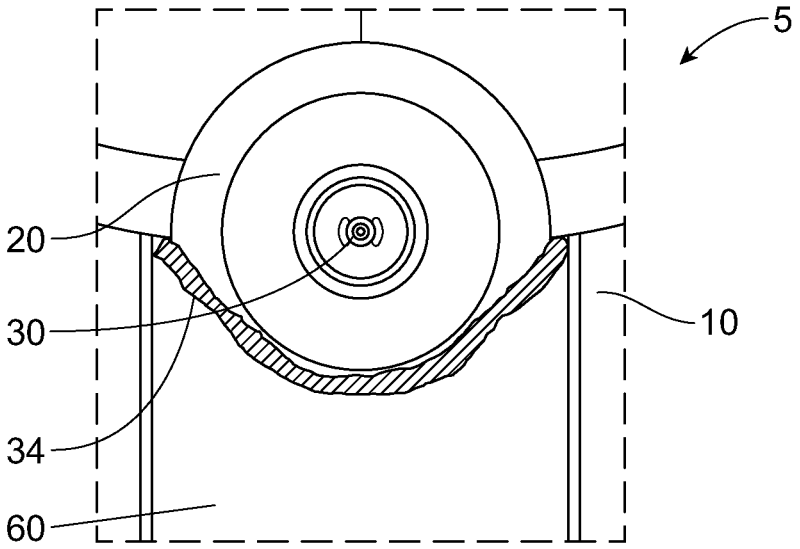
FIG. 6 shows a partial cross-section front view of a nozzle cover and guard.

FIG. 6 shows a partial cross-section front view of the nozzle cover 20 and guard 34. As shown, at least a part of the nozzle cover 20 may be between the guard 34 and the shroud 10.

Figure 7:
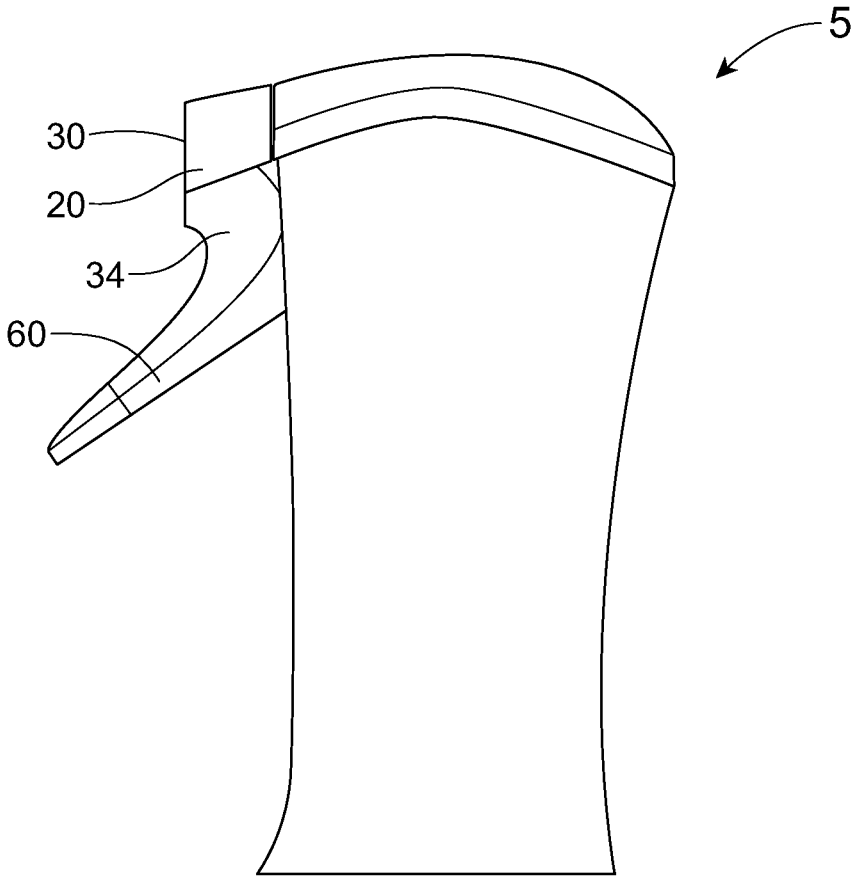
FIG. 7 shows a side view of a spray dispenser having a nozzle guard where the guard and trigger are unitary and the trigger is relaxed.

FIG. 7 shows a side view of a spray dispenser 5 having a nozzle guard 34, wherein the guard 34 is unitary the trigger 60 and extends from the trigger 60 towards the nozzle cover 20. In FIG. 7, the trigger 60 is relaxed, or is in a state of rest as there is no or substantially no active force being placed on the trigger 60. As shown in FIG. 7, the guard 34 and the trigger 60 form a curvature. The curvature may be of any such size and shape as to enable a user to place their finger on the curvature. The curvature may provide an indicator as to where the user should place their finger as to not place their finger in direct contact with the nozzle cover 20. The curvature may also provide ergonomic benefits.

Figure 8:
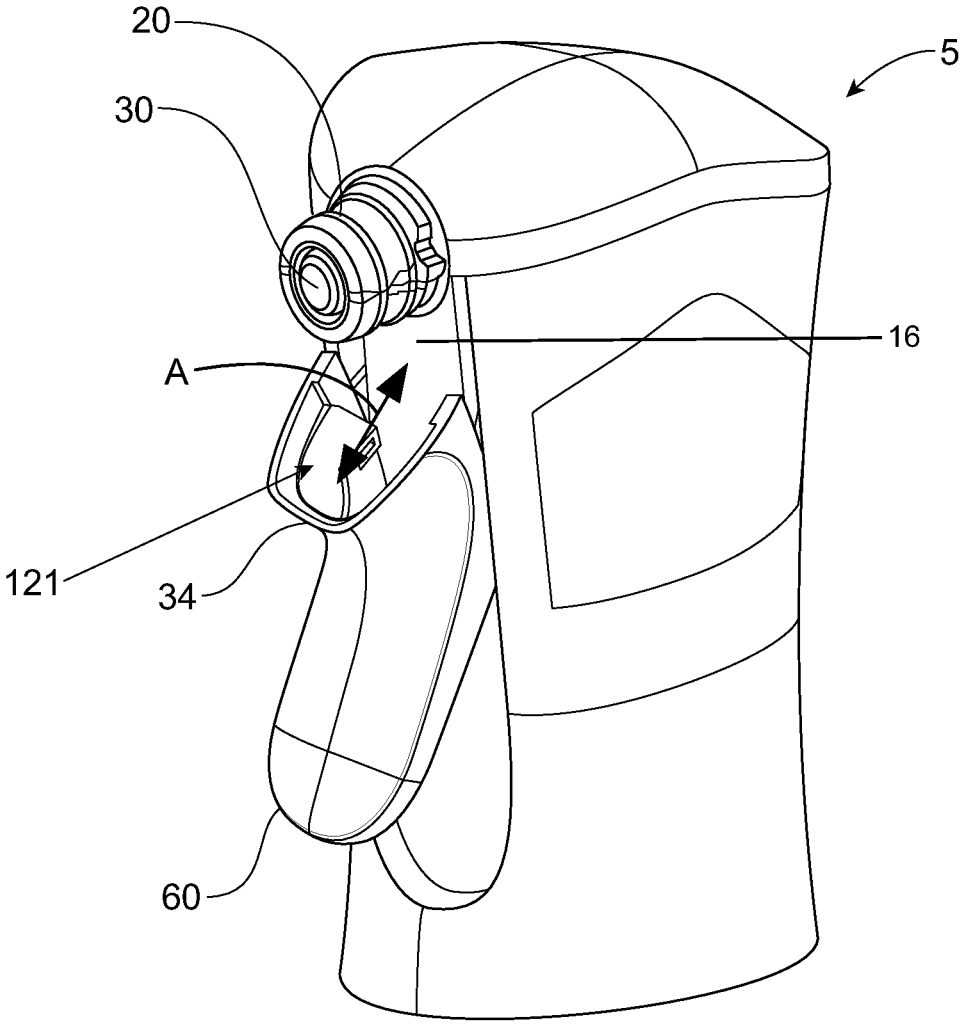
FIG. 8 shows an isometric view of a spray dispenser having a nozzle guard where the trigger is depressed.

FIG. 8 shows an isometric view of a spray dispenser 5 having a nozzle guard 34 where the trigger 60 is depressed, or actuated. The spray dispenser 5 may comprise an area A between the nozzle guard 34 and the shroud walls 16. Such an area A may be of benefit to provide less contact area between the nozzle cover 20 and the guard 34 such that less energy is transferred from the guard 34 to the nozzle cover 20 and thus to the nozzle 30 when the guard 34 is affected by an outside structure or force. The area A may also be beneficial when the nozzle cover 20 has a locking mechanism (not shown) that may extend from the nozzle cover 20. The area A may also be formed by a recess 121, or indentation, of the guard 34 for accepting a portion of the nozzle cover 20. As shown in FIG. 8, when the nozzle cover 20 is within the recess 121, the guard 34 inhibits contact by an outside structure or force with the nozzle cover 20 from at least one direction; the guard 34 is not in direct contact with the nozzle 30; and at least a part of the nozzle cover 20 within the recess 121 is between the guard 34 and the shroud 10.

Figure 9:
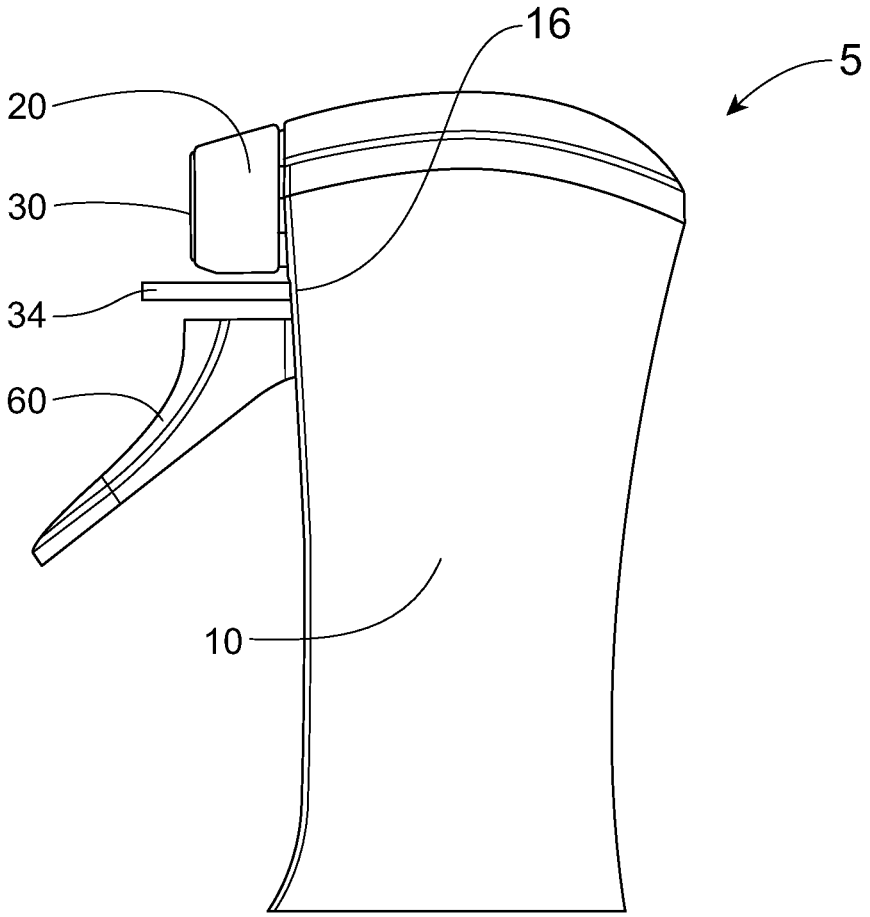
FIG. 9 shows a side view of a spray dispenser having a nozzle guard.

FIG. 9 is a side view of a spray dispenser 5 having a guard 34. As shown in FIG. 9, the guard 34 may extend outwardly from the shroud walls 16. As further shown in FIG. 9, the guard 34 may not be in direct contact with neither the nozzle cover 20 nor the trigger 60. It can be contemplated that the guard 34 may be formed such that it may inhibit contact by an outside structure or force with the nozzle cover 20 from at least one direction, or from at least two directions, or from any number of directions. The guard 34 may be a protrusion extending outwardly from the shroud walls 16.

Figure 10:
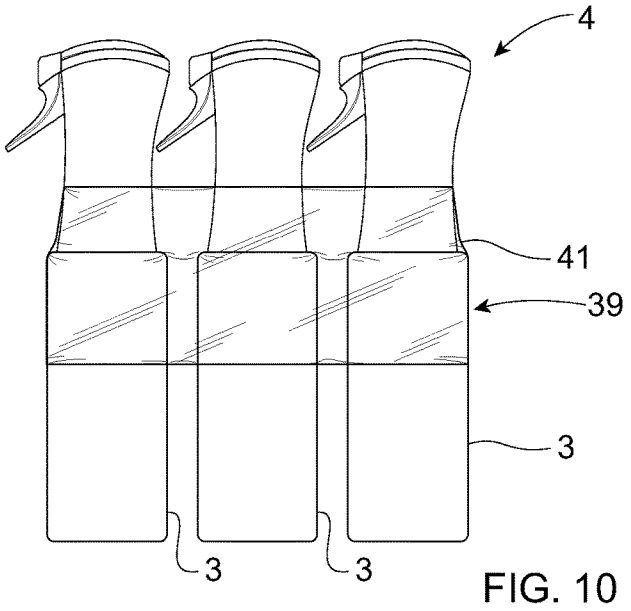
FIG. 10 shows an assembly of liquid dispensing products where at least one liquid dispensing product is partially in contact with a shipping material, wherein the shipping material is shipping wrap.

FIG. 10 shows an assembly of liquid dispensing products 4 where at least one liquid dispensing product 3 is partially in contact with a shipping material 39, wherein the shipping material 39 is shipping wrap 41.

Figure 11:
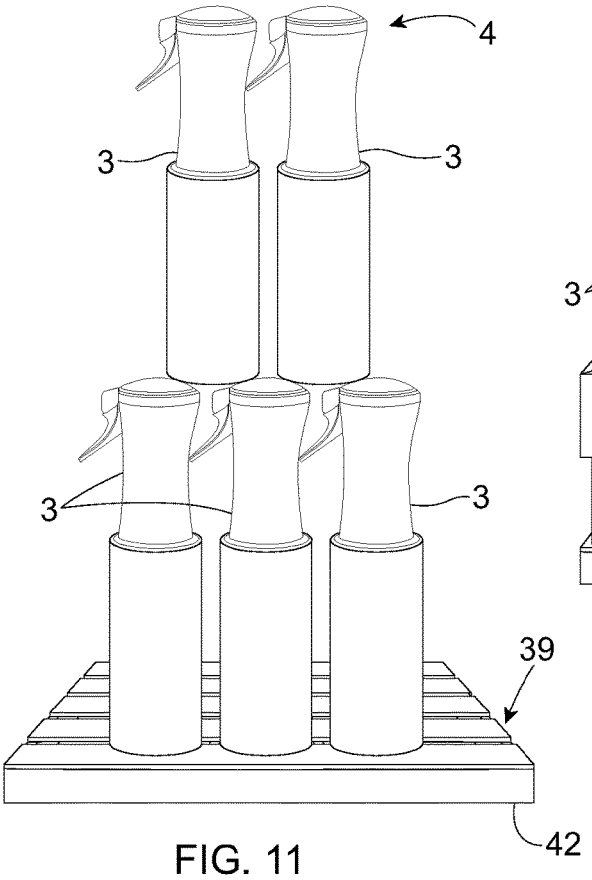
FIG. 11 shows an assembly of liquid dispensing products where at least one liquid dispensing product is at least partially in contact with a shipping material, wherein the shipping material is a receptacle and at least one of the liquid dispensing products is placed at least partially on top of and/or within the receptacle.

FIG. 11 shows an assembly of liquid dispensing products 4 where at least one liquid dispensing product 3 is at least partially in contact with a shipping material 39, wherein the shipping material 39 is a receptacle 42 and at least one of the liquid dispensing products 3 is placed at least partially on top of and/or within the receptacle 42.

Figure 12:
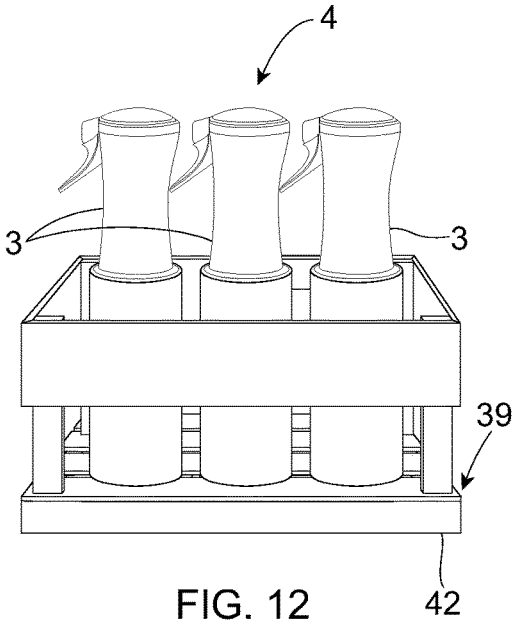
FIG. 12 shows an assembly of liquid dispensing products where all the individual liquid dispensing products are at least partially in contact with a shipping material, wherein the shipping material is a receptacle and all the individual liquid dispensing products are placed at least partially on top of and/or within the receptacle.

FIG. 12 shows an assembly of liquid dispensing products 4 where all the individual liquid dispensing products 3 are at least partially in contact with a shipping material 39, wherein the shipping material 39 is a receptacle 42 and all the individual liquid dispensing products 3 are placed at least partially on top of and/or within the receptacle 42.

Figure 13:
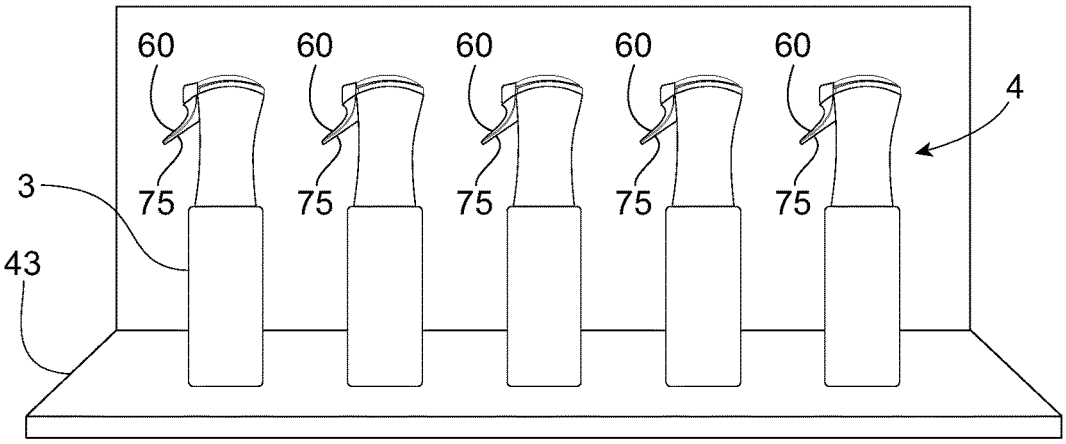
FIG. 13 shows an assembly of liquid dispensing products on a shelf.

FIG. 13 shows an assembly of liquid dispensing products 4 on a shelf 43.

Figure 14:
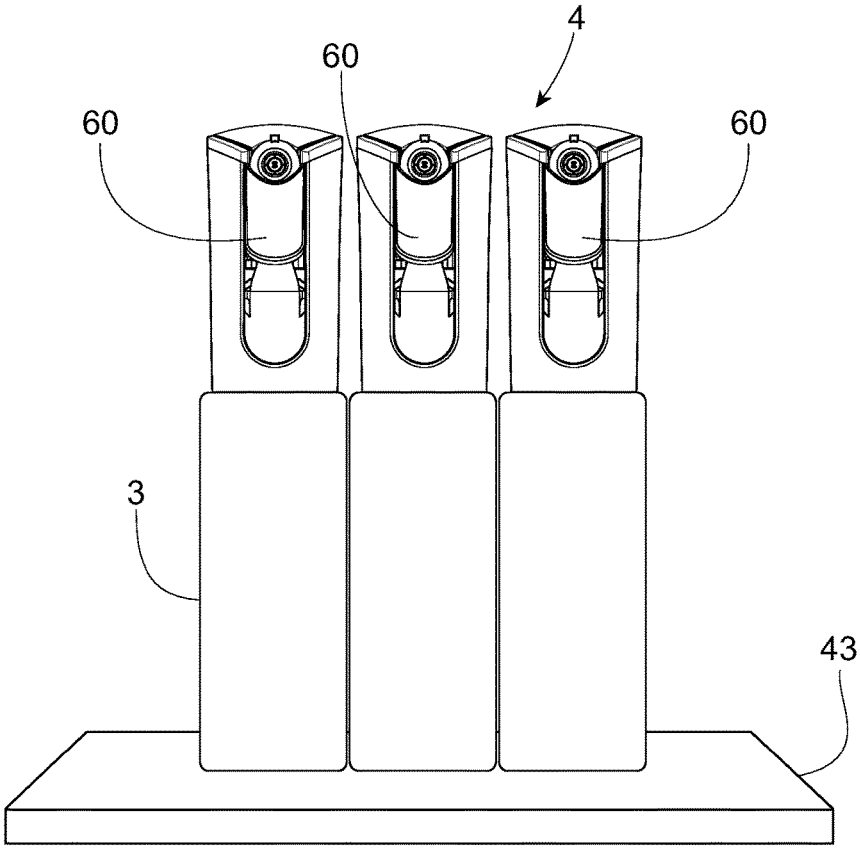
FIG. 14 shows an assembly of liquid dispensing products on a shelf.

FIG. 14 shows an assembly of liquid dispensing products 4 on a shelf 43.

Liquid Dispensing Product

FIG. 1 shows a liquid dispensing product 3. The liquid dispensing product 3 may comprise a spray dispenser 5 and a liquid composition 6, wherein the spray dispenser 5 is configured to spray the liquid composition 6. The liquid dispensing product 3 may further comprise a container 7. The liquid composition 6 may be housed within the container 7 prior to any use of the liquid dispensing product 3 and prior to any actuation of the spray dispenser 5. A user may actuate the spray dispenser 5 and the liquid composition 6 may flow from within the container 7 to the spray dispenser 5 and out of the liquid dispensing product 3 through a nozzle orifice 33 onto a targeted surface outside of the liquid dispensing product 3.

Spray Dispenser

The spray dispenser 5 may comprise a shroud 10, a pump 25, a discharge nozzle 30, and a trigger 60. The spray dispenser 5 may be a trigger spray dispenser. The spray dispenser 5 may be any trigger spray dispenser known to one skilled in the art capable of moving liquid, such as a liquid composition, from a container onto a targeted surface outside a liquid dispensing product by use of a trigger. The spray dispenser 5 may be a continuous flow trigger spray dispenser. The spray dispenser 5 may be an automatic trigger spray dispenser. The spray dispenser 5 may be a manual trigger spray dispenser. The spray dispenser 5 be a pre-compression trigger spray dispenser. The spray dispenser 5 may have a buffer system.

Shroud and Pump

As shown in FIG. 2, the spray dispenser 5 may comprise a shroud 10. The shroud 10 may house a pump 25. The shroud 10 may partially house a pump 25. The shroud 10 may cover a pump 25 to protect the pump 25 from contact with an outside force. The shroud 10 may house or may partially house any other component typically found in a trigger spray dispenser, such as, for example, a buffer system or a connecting piece to connect the shroud 10 to a container 7.

The shroud 10 may comprise a shroud top surface 15. The shroud top surface 15 may obscure the pump 25 from view from at least one direction. The shroud top surface 15 may obscure the pump 25 from view from the top direction.

The shroud 10 may comprise a shroud bottom edge 17 opposing the shroud top surface 15. The shroud 10 may comprise shroud walls 16 connecting the shroud top surface 15 to the shroud bottom edge 17. The shroud walls 16 may surround the pump 25. The shroud walls 16 may partially surround the pump 25. The shroud top surface 15 may lie perpendicular to the shroud walls 16.

The shroud 10 may be of slightly cylindrical or cylindrical shape. The shroud 10 may be of any shape known by one skilled in the art to partially house or house a pump 25. The shroud 10 may be made of plastic. The shroud 10 may be made of any material known to one skilled in the art capable of forming a shroud for a trigger spray dispenser 5 such as that of the current invention. The shroud 10 may be of any shape and curvature to enable ease of gripping by a user. The shroud 10 may comprise gripping features, such as, but not limited to, tapering in the midsection and ridges and/or bumps to enable gripping. Tapering in the shroud 10 may also provide a visual cue to the user as to orientation of the spray dispenser 5.

The shroud 10 may be connected to a container 7. The shroud 10 may be connected to the container 7 at the shroud bottom edge 17. When the shroud 10 is connected to the container 7, the shroud bottom edge 17 may be proximal the container 7. When the shroud 10 is connected to the container 7, the shroud bottom edge 17 may be in contact with the container 7. The shroud 10 may be screwed onto the container 7. The shroud 10 may be snapped onto the container 7.

As shown in the partial cutaway of FIG. 2, the shroud 10 may house a pump 25. The pump 25 may be any device or system of devices known to one skilled in the art capable of moving fluids, including liquids and gases, by mechanical action. The pump 25 may be any pump known to one skilled in the art used within spray dispensers, particularly trigger spray dispensers. The pump 25 may comprise a buffer system. The pump 25 may comprise a compression chamber. The pump 25 may comprise a buffer system operatively engaged with a compression chamber. The pump 25 may further comprise any other component known to one skilled in the art required for the functioning of the buffer system and/or compression chamber. The buffer system may comprise a buffer piston. The buffer system may comprise a buffer chamber. The buffer system may comprise a buffer spring. The buffer system may comprise a buffer piston, buffer chamber, and buffer spring. The buffer system may comprise any other component known to one skilled in the art required for the functioning of the buffer system. Examples of buffer systems can be found, for example, in U.S. Pat. No. 8,905,271; U.S. Pub. 2014/246506; and U.S.

Pub. 2013/112766. The present invention is particularly beneficial for use in spray dispensers having buffer systems as when a spray dispenser has a buffer system, actuation of the trigger 60 may result in an increase of liquid composition 6 into the buffer system. The increase of liquid composition 6 into the buffer system may lead to greater pressure in the buffer system until the liquid composition 6 is discharged through the nozzle 30. When there is a barrier to the nozzle flow path and the trigger 60 is capable of being actuated, even slightly, more liquid composition 6 may move into the buffer system and the pressure will increase. Too high a pressure build-up may damage the spray dispenser 5 system. Additionally, a pressure build-up may result in undesirable spray patterns as the pressure may affect the particle size upon spraying of the liquid composition, which may lead to an unintended more mist-like spray pattern. Misalignment of the nozzle 30 can lead to such build-up.

Nozzle Cover and Nozzle

The spray dispenser 5 may comprise a nozzle cover 20. The spray dispenser 5 may comprise a rotatable nozzle cover 20. The nozzle cover 20 may house a discharge nozzle 30. The nozzle cover 20 may be rotatable about a central axis 40 thereof. The nozzle cover 20 may be rotatable about a central axis 40.

The nozzle cover 20 may house a discharge nozzle 30 to protect the nozzle 30 from contact with an outside force. The nozzle cover 20 may surround or partially surround the nozzle 30. The nozzle cover 20 may be attached to the nozzle 30 by threads. The nozzle cover 20 may be attached to the nozzle 30 by snapping pieces. The nozzle cover 20 may be attached to the nozzle 30 by any means of attachment known to one skilled in the art that enable the nozzle cover 20 to rotate. The nozzle cover 20 may be rotatable about a central axis 40 thereof. The nozzle 30 may have a central axis and the nozzle cover 20 may be rotatable about the nozzle 30 central axis. The nozzle 30 central axis may be the same as the nozzle cover 20 central axis 40.

The nozzle cover 20 may have a nozzle cover front edge 21 and a nozzle cover back edge 22 opposing the nozzle cover front edge 21 and facing the shroud 10. The nozzle cover 20 may have nozzle cover walls 23 connecting the nozzle cover front edge 21 to the nozzle cover back edge 22. The nozzle cover walls 23 may surround the nozzle 30. The nozzle cover front edge 21 and the nozzle cover back edge 22 may be in a parallel relationship.

The nozzle cover 20 may be of slightly conical or conical shape. The nozzle cover 20 may be of slightly cylindrical or cylindrical shape. The nozzle cover 20 may be of any shape known to one skilled in the art to partially house or house the nozzle 30. The nozzle cover 20 may be made of plastic. The nozzle cover 20 may be made of any material known to one skilled in the art. The nozzle cover 20 may have gripping features such as, but not limited to, ridges and/or bumps, which may assist the user in gripping and rotating the nozzle cover 20. The nozzle cover 20 may have one or more visual cues, such as, but not limited to, text and/or arrows guiding the user to which direction the user is to rotate the nozzle cover 20 to lock and to unlock the spray dispenser 5.

The nozzle cover 20 may extend outwardly from the shroud 10. The nozzle cover 20 may be located closer to the shroud top surface 15 than to the shroud bottom edge 17. The nozzle cover 20 may be located above the trigger 60. The nozzle cover 20 may be located directly above the trigger 60.

The nozzle cover 20 may house a discharge nozzle 30. The discharge nozzle 30 may extend from the shroud 10. The nozzle 30 may comprise a nozzle orifice 33. The nozzle orifice 33 may be an opening where liquid, such as the liquid composition 6, leaves the liquid dispensing product 3 and the spray dispenser 5. The nozzle orifice 33 may connect to a nozzle flow pathway (not pictured). The nozzle flow pathway may be where liquid, such as the liquid composition 6, flows from within the spray dispenser 5 to the nozzle orifice 33. The nozzle flow pathway may be a hollow chamber. The nozzle flow pathway may be made of any material known to one skilled in the art capable of facilitating the movement of liquid from within the spray dispenser 5 to exiting the liquid dispensing product 3 and the spray dispenser 5 through the nozzle orifice 33. The nozzle flow pathway may be cylindrical. The nozzle flow pathway may be any shape known to one skilled in the art capable of facilitating the movement of liquid, such as the liquid composition 6, from within the spray dispenser 5 to exiting the liquid dispensing product 3 and the spray dispenser 5 through the nozzle orifice 33. The nozzle cover 20 may partially house the nozzle flow pathway.

The discharge nozzle 30 may be in fluid communication with the pump 25 such that, when the pump 25 is actuated, liquid flows from the container 7, through the spray dispenser 5, through the nozzle flow pathway, and through the nozzle orifice 33, ultimately exiting the liquid dispensing product 3 onto, for example, a surface.

Nozzle Guard

The spray dispenser 5 may comprise a nozzle guard 34. The nozzle guard 34 may be proximate the nozzle cover 20. The nozzle guard 34 may inhibit contact by an outside structure or force with the nozzle cover 20 from at least one direction. The guard 34 may not be in direct contact with the nozzle 30. Without wishing to be bound by theory, the guard 34 not being in direct contact with the nozzle 34 may allow for less energy to be transferred from a contact with an outside structure or force exerted on the guard 34 to the nozzle 30, such that the nozzle 30 will not be misaligned. The nozzle guard 34 may be in direct contact with one or more points with the nozzle cover 20. However, it may be beneficial for the nozzle guard 34 to have as few points of contact with the nozzle cover 20 for reasons provided above.

The nozzle guard 34 may extend from the shroud walls 16. The nozzle guard 34 may be unitary with the shroud walls 16, for the benefit of manufacturing ease. The nozzle guard 34 may extend in between the nozzle cover 20 and the trigger 60, when the trigger 60 is beneath the nozzle cover 20. The nozzle guard 34 may extend above, or partially above, the nozzle cover 20. The nozzle guard 34 may extend to the sides of the nozzle cover 20. The nozzle guard 34 may extend outward from the shroud walls 16 at any placement surrounding or partially surrounding the nozzle cover 20 as to inhibit contact by an outside force or structure to the nozzle cover 20. The guard 34 may extend outwardly from the shroud walls 16 to project at a length slightly further than the nozzle cover 20. The guard 34 may extend outwardly from the shroud walls 16 to project at any such length that would be beneficial in providing protection to the nozzle cover 20 from outside contact or force but would not affect the ability of the spray dispenser 5 to dispense liquid nor affect the spray pattern of the liquid dispensed.

The nozzle guard 34 may extend from the trigger from the trigger 60 towards the nozzle cover 20. The nozzle cover 34 may be unitary the trigger 60, to provide the benefit of ease of manufacturing. The nozzle guard 34 may extend such that the guard 34 partially surrounds the nozzle cover 24. It is contemplated that partially surrounding the nozzle cover 20 is to be accomplished such that the guard 34 would not affect the ability of the spray dispenser 5 to dispense liquid nor affect the spray pattern of the liquid dispensed.

The nozzle guard 34 may be attached to the shroud walls 16 or to the trigger 60 by threads, snapping pieces, and/or may be formed as one unitary piece. The nozzle guard 34 may be attached to the shroud walls 16 or trigger 60 by any means of attachment known to one skilled in the art.

The nozzle guard 34 may be of any shape conducive to inhibiting contact from an outside structure or force to the nozzle cover 20. For example, when the nozzle cover 20 is of slightly conical shape, the guard 34 may also take a curved shape such that the guard 34 may partially surround the nozzle cover 20.

The guard 34 may be made of plastic. The guard 34 may be made of any material known to one skilled in the art.

Trigger

The spray dispenser 5 may comprise a trigger 60. The trigger 60 may be operatively engaged with the pump 25 such that actuation of the trigger 60 in turn may actuate the pump 25. The term "actuation" or any of its derivatives herein refers to the causing of the mechanism or part to operate as its intended purpose. To use the trigger 60, a user may place their finger on the trigger front surface 65 and apply force to the trigger 60 to engage the trigger 60 in actuating the pump 25. The trigger 60 may be any device or system of devices known to one skilled in the art capable of actuating the pump 25 when force is applied. The trigger 60 may be any device or system of devices known to one skilled in the art used in spray dispensers for liquid discharge.

The trigger 60 may extend from the shroud 10. The trigger 60 may be located beneath the nozzle cover 20. At least a portion of the trigger 60 may be located directly beneath the nozzle cover 20. The entire trigger 60 may be located directly beneath the nozzle cover 20. The trigger 60 may face the user when the spray dispenser 5 is facing the user. The trigger 60 may be located on either side of the shroud 10 when the spray dispenser 5 is facing the user. The trigger 60 may be hingedly connected to the pump 25. The trigger 60 may be hingedly connected to the shroud 10.

As shown in FIG. 3, the trigger 60 may have a trigger front surface 65 facing away from the shroud 10, an opposing trigger back surface 70 and a pair of opposing trigger lateral edges 75. The trigger front surface 65 may be where a user places their fingers. The trigger front surface 65 may have ridges to help the user grip the trigger 60. The trigger front surface 65 may be smooth to not cause discomfort to the user. The trigger back surface 70 may have ridges. The trigger back surface 70 may be smooth. The trigger lateral edges 75 may lie perpendicular to the trigger front surface 65. The trigger lateral edges 75 may extend such that the trigger lateral edges 75 are proximal or are in direct contact with the shroud 10.

The trigger 60 may comprise a movable part 63 operatively engaged with a means of releasing the movable part (not shown). The movable part 63 may be, for example, a lever. The means of releasing the movable part may be, for example, a catch or detent. As shown in FIG. 3, the movable part 63 may be a lever or any solid projection a user can apply pressure to in order to actuate the trigger 60. The movable part 63 may be curved for ergonomic support of a user's finger. The movable part 63 may be substantially rectangular for ease of manufacturing. The movable part 63 may have a curved free end for a visual aesthetic benefit and/or to not have sharp edges a user might find uncomfortable. The movable part 63 may be hollow. The movable part 63 may be solid. The movable part 63 may have openings extending through movable part 63.

Liquid Composition

The liquid dispensing product 3 may comprise a liquid composition 6. The liquid composition 6 may be housed within the container 7 attached to the spray dispenser 5 before actuation of the spray dispenser 5.

The liquid composition 6 may comprise any component found in a liquid composition known to one skilled in the art to clean surfaces, such as dishware, sinks, countertops, and clothing, or any other surface found in a household. The liquid composition 6 may be a liquid composition 6 such as any such composition discussed in U.S. Publications 2017/0015953 A1, 2017/0015940 A1, 2017/0015962 A1, 2017/0015961 A1, 2017/0015941 A1, or 2017/0015960 A1, incorporated herein by reference.

The liquid composition 6 may be a cleaning composition. The liquid composition 6 may be a hand dishwashing cleaning product. The liquid composition 6 may be an air freshener, a pesticide, an insecticide, a hard surface cleaner, and/or any other household liquid composition. The liquid composition 6 may be any other liquid composition known to one skilled in the art of use with a spray dispenser 5.

The liquid composition 6 may comprise from about 5% to about 15%, by weight of the liquid composition 6, of a surfactant system. The liquid composition 6 may comprise from about 6% to about 14%, by weight of the liquid composition 6, of a surfactant system. The liquid composition 6 may comprise from about 7% to about 12%, by weight of the liquid composition 6, of a surfactant system.

The surfactant system may comprise an anionic surfactant. The surfactant system may further comprise a co-surfactant selected from the group consisting of amphoteric surfactants, zwitterionic surfactants, and mixtures thereof. The surfactant system can optionally comprise a non-ionic surfactant and/or a cationic surfactant.

Assembly of Liquid Dispensing Products

As shown in FIGS. 10-14, the liquid dispensing product 3 may be an assembly of liquid dispensing products 4. The assembly of liquid dispensing products 4 may mean at least two individual liquid dispensing products 3. The assembly of liquid dispensing products 4 may be presented to a consumer on a shelf 43, product display, or other arrangement suitable for presenting consumer products to a consumer in a retail environment. The assembly of liquid dispensing products 4 may be presented to a consumer and/or to a retailer in a shipping material 39, such as for example, in shipping wrap 41 or in a receptacle 42.

The assembly of liquid dispensing products 4 can be, by way of non-limiting example, a plurality of liquid dispensing products 3 according to the present invention. The assembly of liquid dispensing products 4 can be, by way of non-limiting example, a plurality of liquid dispensing products 3 according to the present invention wherein at least one individual liquid dispensing product 3 may be distinct in at least one aspect from any other individual liquid dispensing product 3 in the assembly 4, such as, for example, whereas one liquid dispensing product 3 comprises a guard 34 extending from the shroud walls 16 and another liquid dispensing product 3 comprises a guard 34 extending from and unitary with the trigger 60. The assembly of liquid dispensing products 4 can be, by way of non-limiting example, a plurality of liquid dispensing products 3 according to the present invention wherein each of the individual liquid dispensing products 3 is indistinct from any other of the individual liquid dispensing products 3 in the assembly 4.

Method of Shipping

A method of shipping one or more liquid dispensing products 3 is set forth herein.

The method of shipping one or more liquid dispensing products 3 may comprise the steps of providing one or more liquid dispensing products 3. The step of providing one or more liquid dispensing products 3 may comprise providing an assembly of liquid dispensing products 4. The liquid dispensing products 3 may be according to the present invention.

After the step of providing one or more liquid dispensing products 3, the method of shipping one or more liquid dispensing products 3 may further comprise the step of facilitating the transfer of the one or more liquid dispensing products 3 from a first geographical address to a second geographical address. A geographical address need not be a formal address but may be any geographic coordinates. The step of facilitating the transfer of the one or more liquid dispensing products 3 from a first geographical address to a second geographical address can be, by way of non-limiting example, moving the one or more liquid dispensing products 3 on a vehicle, such as a car or truck, or by any other mode of transportation, including but not limited to, a train, a bus, an airplane, a water vessel, by a human, by a non-human. The step of facilitating the transfer of the one or more liquid dispensing products 3 from a first geographical address to a second geographical address may be as simple as a human carrying one or more liquid dispensing products 3 one or more steps.

As shown in FIGS. 10, 11, and 12, the step of facilitating the transfer of one or more liquid dispensing products 3 from a first geographical address to a second geographical address may comprise wherein at least one of the liquid dispensing products 3 may be at least partially in contact with a shipping material 39 for any duration of time. The step of the transfer of one or more liquid dispensing products 3 from a first geographical address to a second geographical address may comprise wherein at least one of the liquid dispensing products 3 may be at least partially in contact with a shipping material 39 for any duration of time may comprise that at least one of the liquid dispensing products 3 has a nozzle guard 34.

As shown in FIG. 10, the shipping material 39 may comprise shipping wrap 41, wherein at least one of the liquid dispensing products 3 is at least partially in contact with the shipping wrap 41. The shipping material 39 may comprise shipping wrap 41, wherein each of the individual liquid dispensing products 3 is at least partially in contact with the shipping wrap 41. Shipping wrap 41 may comprise by way of non-limiting example, plastic, stretch film, and/or tape. The shipping wrap 41 may be wrapped around one or more of the liquid dispensing products 3 to keep the one or more liquid dispensing products 3 bound together for ease of facilitating the transfer from a first geographical address to a second geographical address, such as to stabilize, protect, and/or secure the one or more liquid dispensing products 3. Shipping wrap 41 may comprise any such material known to one skilled in the art to be used in conjunction with shipping a liquid dispensing product 3.

As shown in FIG. 11, the shipping material 39 may comprise a receptacle 42, wherein at least one of the liquid dispensing products 3 is at least partially in contact with, at least partially on top of, and/or at least partially within the receptacle 42. This arrangement may be beneficial when stacking the individual liquid dispensing products 3 to provide for a greater number of individual liquid dispensing products 3 to fit within the space and/or the benefit of curtailing the quantity and/or amount of shipping materials for shipping or movement of the assembly of one or more liquid dispensing products 4. The nozzle guards 34 are beneficial when stacking such individual liquid dispensing products 3 as the guards 34 inhibit the nozzles 30 from outside force.

As shown in FIG. 12, all the individual liquid dispensing products 3 of the assembly of one or more liquid dispensing products 4 may be placed at least partially on top of and/or within the receptacle 42. This arrangement may be beneficial when shipping or moving a fewer number of individual liquid dispensing products 3 as each individual liquid dispensing product 3 may be stabilized by being at least partially in contact with the receptacle 42.

The receptacle 42 may be any such object or space used to contain the one or more liquid dispensing products 3. The receptacle 42 may be a box or carton. The receptacle 42 may be a pallet or any type of transport structure. The receptacle 42 may be any such object or space used to contain one or more of the liquid dispensing products 3 together for ease of facilitating the transfer from a first geographical address to a second geographical address, such as to stabilize, protect, and/or secure the one or more liquid dispensing products 3.

As shown in FIGS. 13 and 14, the assembly of one or more liquid dispensing products 4 may be placed on a shelf 43, such as that of a store shelf for display to potential consumers. As shown in FIG. 14, when placed on a shelf 43, the assembly of one or more liquid dispensing products 4 may be displayed such a trigger lateral edge 75 faces the consumer. Displaying the assembly of one or more liquid dispensing products 4 wherein the trigger lateral edge 75 faces the consumer may be beneficial in demonstrating the ergonomic and sophisticated curvature of the trigger 60 and/or may be aesthetically appealing to potential consumers. As shown in FIG. 15, when placed on a shelf 43, the assembly of one or more liquid dispensing products 4 may be displayed such that the trigger 60 faces the consumer. Displaying the assembly of one or more liquid dispensing products 4 wherein the trigger 60 faces the consumer may be beneficial in consolidating shelf space, such as, for example, if the trigger 60 is of a length to extend further than the outer boundary of the container 7.

Method of Use

A method for using a liquid dispensing product 3 comprising a spray dispenser 5 and a liquid composition 6, wherein the spray dispenser 5 comprises a nozzle guard 34, to spray the liquid composition 6 is set forth herein.

The method of using the liquid dispensing product 3 may be performed by a user or by a machine. When the method is performed by a user, the user may hold the spray dispenser 5 in one hand, for example, the user's right hand. The user's hand may wrap around the shroud 10 such that the user's right index finger may be on the trigger front surface 65 and the rest of the user's fingers may lie on the shroud 10 beneath the trigger 60. The user's right index finger may be on the curvature formed by the guard 34 and trigger 60. Before beginning the method, the spray dispenser 5 may be such that the nozzle 30 and/or trigger 60 is in a locked position, if the spray dispenser 5 has such a locking mechanism. When the spray dispenser 5 comprises one or more locking mechanisms, the method of using the liquid dispensing product 3 will comprise the first step of unlocking the one or more locking mechanisms before using the spray dispenser 5.

The method of using the liquid dispensing product 3 may further comprise the step of placing the user's hand on the spray dispenser 5 such that the user's finger is not placing direct force on the nozzle cover 20. The user's hand may be on the guard 34 or proximate the guard 34, on the trigger front surface 65 or anywhere else on the spray dispenser 5 convenient to allow for the user's hand to exert a force to cause actuation of the spray dispenser 5.

The method of using the liquid dispensing product 3 may further comprise the step of aiming the spray dispenser 5 at a targeted surface. The targeted surface may be a solid surface such as a kitchen counter, a bathroom sink, or a human hand or it may be a targeted area such as into the air. The targeted surface may be any such surface capable of receiving a sprayed liquid, such as that of the liquid composition 6. The targeted surface may be dishware and/or tableware. The targeted surface may be a cleaning implement, for example, a sponge and/or a cloth. At this point in the method, the trigger 60 may be in the trigger first position 61 or the trigger 60 is relaxed.

The method of using the liquid dispensing product 3 then further comprises the step of depressing the trigger 60 to actuate the pump 25. The step of depressing the trigger 60 is preferably after the step of aiming the spray dispenser 5 at a targeted surface so that the liquid composition 6 is sprayed where the user intends for the liquid composition 6 to be sprayed. The step of depressing the trigger 60 may be done by the user placing a force against the movable part 63 of the trigger 60 using the user's own hand or by use of mechanical means to place a force against the trigger 60. The trigger 60 may be movable in at least an axially downward direction and the trigger 60 may be depressed in at least an axially downward direction, or, alternatively, in a direction towards the shroud 10, to actuate the pump 25. The step of depressing the trigger 60 may be done by any means known to one skilled in the art to depress or actuate a trigger 60. At this point in the method, the trigger 60 may be in the trigger second position 62, or the trigger 60 is depressed. The actuation of the trigger 60 may actuate the pump 25. The actuation of the pump 25 may cause liquid to spray out of the spray dispenser 5 through the discharge nozzle 30 onto a surface external to the liquid dispensing product 3.

The method of using a liquid dispensing product 3 may comprise the step of the user determining the allotment of liquid composition 6 the user desires to discharge and determining that the desired allotment of liquid composition 6 discharged has been attained. After the step of determining the desired allotment of liquid composition 6 discharged and determining that the desired allotment of liquid discharged has been attained, the method may further comprise the step of subsequently releasing the trigger 60 to terminate actuation of the pump 25. When the user releases the trigger 60, the trigger 60 may move in at least axially upwards direction, or alternatively, away from the shroud 10. At this point in the method, the release of the trigger 60 may cause the trigger 60 to return to the trigger first position 61 where the trigger 60 is relaxed.

Following the step of releasing the trigger 60 to terminate actuation of the pump 25, the method may comprise the repetition of the steps of aiming the spray dispenser 5 at a targeted surface, depressing the trigger 60 to actuate the pump 25, determining the allotment of liquid composition 6 the user desires to discharge and determining that the desired allotment of liquid composition 6 discharged has been attained, and releasing the trigger 60 to terminate actuation of the pump 25, for as many repetitions the user desires until attaining the desired liquid composition 6 allotment and/or spray coverage the user desires.

Once the user has determined the user is finished using the liquid dispensing product 3 in the given circumstance and the trigger 60 is in the trigger first position 61 or the trigger 60 is relaxed, the method may further comprise the step of re-engaging the one or more locking mechanisms if the spray dispenser 5 comprises any.

The method may further comprise the step of the storing the liquid dispensing product 3 in a storage space. The user may place the liquid dispensing product 3 in a cabinet or by the user's sink until the next time the user decides to use the liquid dispensing product 3.

Combinations

A. A liquid dispensing product 3 comprising:
- a spray dispenser 5, said spray dispenser comprising:
- a shroud 10 housing a pump 25, wherein said shroud comprises a shroud top surface 15, a shroud bottom edge 17 opposing said shroud top surface, and shroud walls 16 connecting the shroud top surface to the shroud bottom edge;
- a rotatable nozzle cover housing 20 a discharge nozzle 30 wherein said nozzle cover is rotatable about a central axis 40 thereof, and wherein said discharge nozzle is in fluid communication with said pump;
- a trigger 60 operatively engaged with said pump, said trigger having a trigger front surface 65 facing away from said shroud and an opposing trigger back surface 70 and a pair of opposing trigger lateral edges 75;
- a guard 34 proximate said nozzle cover, wherein said guard inhibits contact by an outside structure or force with said nozzle cover from at least one direction and wherein said guard is not in direct contact with said nozzle; and a liquid composition 6 comprising from about 5% to about 15%, by weight of said composition, of a surfactant system; wherein said spray dispenser is configured to spray said composition.

B. A liquid dispensing product according to paragraph A, wherein said guard is at least partially beneath said nozzle cover.

C. A liquid dispensing product according to any one of paragraphs A or B, wherein said guard is at least partially between said nozzle cover and said trigger.

D. A liquid dispensing product according to any one of paragraphs A to C, wherein said nozzle cover comprises a nozzle cover front edge 21, a nozzle cover back edge 22 opposing said nozzle cover front edge and facing said shroud, and nozzle cover walls 23 connecting said nozzle cover front edge to said nozzle cover back edge, wherein said guard at least partially surrounds said nozzle cover walls.

E. A liquid dispensing product according to any of paragraphs A to D, wherein said guard inhibits contact by an outside structure or force with said nozzle cover from at least two directions or at least three directions.

F. A liquid dispensing product according to any of paragraphs A to E, wherein at least a part of said nozzle cover is between said guard and said shroud.

G. A liquid dispensing product according to any one of paragraphs A to F, wherein said spray dispenser comprises an area A formed by a recess for accepting a portion of said nozzle cover between said guard and said shroud walls.

H. A liquid dispensing product according to any one of paragraphs A to G, wherein said guard is unitary said trigger and extends from said trigger towards said nozzle cover and wherein said guard and said trigger form a curvature for placement of a finger.

I. A liquid dispensing product according to any one of paragraphs A to G, wherein guard is not in direct contact with neither said nozzle cover nor said trigger.

J. An assembly of liquid dispensing products 4, each member of said assembly individually being a liquid dispensing product according to any one of paragraphs A to I.

K. A method of shipping one or more liquid dispensing products according to any one of paragraphs A to J, said method comprising the steps of:

providing one or more of said liquid dispensing products; and facilitating the transfer of said one or more liquid dispensing products from a first geographical address to a second geographical address.

L. A method of shipping according to paragraph M, wherein said step of facilitating the transfer of said one or more liquid dispensing products from said first geographical address to said second geographical address comprises at least one of said liquid dispensing products at least partially in contact with a shipping material 39 for any duration of time.

M. A method of shipping according to paragraph N, wherein said shipping material comprises shipping wrap 41 and/or a receptacle 42, wherein at least one of said liquid dispensing products is at least partially in contact with said shipping wrap and/or wherein at least one of said liquid dispensing products is placed at least partially on top of and/or at least partially within said receptacle.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid dispensing product comprising:

a spray dispenser, said spray dispenser comprising:

a shroud housing a pump, wherein said shroud comprises a shroud top surface, a shroud bottom edge opposing said shroud top surface, and shroud walls connecting the shroud top surface to the shroud bottom edge;

a rotatable nozzle cover housing a discharge nozzle wherein said nozzle cover is rotatable about a central axis thereof, and wherein said discharge nozzle is in fluid communication with said pump;

a trigger operatively engaged with said pump, said a trigger having a trigger front surface facing away from said shroud and an opposing trigger back surface, and a pair of opposing trigger lateral edges;

a guard proximate said nozzle cover, wherein said guard inhibits contact by an outside structure or force with said nozzle cover from at least one direction and wherein said guard is not in direct contact with said nozzle, wherein said guard is unitary said trigger and extends from said trigger towards said nozzle cover; and a liquid composition comprising from about 5% to about 15%, by weight of said composition, of a surfactant system; and wherein said spray dispenser is configured to spray said composition.

2. The liquid dispensing product according to claim 1, wherein said guard is at least partially beneath said nozzle cover.

3. The liquid dispensing product according to claim 1, wherein said guard is at least partially between said nozzle cover and said trigger.

4. The liquid dispensing product according to claim 1, said nozzle cover having a nozzle cover front edge, a nozzle cover back edge opposing said nozzle cover front edge and facing said shroud, and nozzle cover walls connecting said nozzle cover front edge to said nozzle cover back edge, wherein said guard at least partially surrounds said nozzle cover walls.

5. The liquid dispensing product according to claim 4, wherein said nozzle cover is of conical shape.

6. The liquid dispensing product according to claim 1, wherein said guard inhibits contact by an outside structure or force with said nozzle cover from at least two directions or at least three directions.

7. The liquid dispensing product according to claim 1, wherein at least a part of said nozzle cover is between said guard and said shroud.

8. The liquid dispensing product according to claim 1, wherein said spray dispenser comprises an area A between said guard and said shroud walls.

9. The liquid dispensing product according to claim 1, wherein said guard and said trigger form a curvature for placement of a finger.

10. The liquid dispensing product according to claim 1, wherein said guard inhibits contact by an outside structure or force with said nozzle cover from at least one direction.

11. The liquid dispensing product according to claim 1, wherein said guard is not in direct contact with said nozzle.

12. The liquid dispensing product according to claim 1, wherein said guard comprises a recess for accepting a portion of said nozzle cover wherein at least part of nozzle cover within said recess is between said guard and said shroud.

13. An assembly of liquid dispensing products each member of said assembly each individually being a liquid dispensing product according to claim 1.

14. A method of shipping one or more liquid dispensing products, said method comprising the steps of:

providing one or more liquid dispensing products, said liquid dispensing products each individually comprising:

a spray dispenser, said spray dispenser comprising:

a shroud housing a pump, wherein said shroud comprises a shroud top surface, a shroud bottom edge opposing said shroud top surface, and shroud walls connecting the shroud top surface to the shroud bottom edge;

a rotatable nozzle cover housing a discharge nozzle wherein said nozzle cover is rotatable about a central axis thereof, and wherein said discharge nozzle is in fluid communication with said pump;

a trigger operatively engaged with said pump, said a trigger having a trigger front surface facing away from said shroud and an opposing trigger back surface, and a pair of opposing trigger lateral edges;

a guard proximate said nozzle cover, wherein said guard inhibits contact by an outside structure or force with said nozzle cover from at least one direction and wherein said guard is not in direct contact with said nozzle, wherein said guard is unitary said trigger and extends from said trigger towards said nozzle cover; and a liquid composition comprising from about 5% to about 15%, by weight of said composition, of a surfactant system;

wherein said spray dispenser is configured to spray said composition; and facilitating the transfer of said one or more liquid dispensing products from a first geographical address to a second geographical address.

15. The method according to claim 14, wherein said step of facilitating the transfer of said one or more liquid dispensing products from said first geographical address to said second geographical address comprises said at least one of said liquid dispensing products at least partially in contact with a shipping material for any duration of time.

16. The method according to claim 15, wherein said shipping material comprises a receptacle, wherein at least one of said liquid dispensing products is placed at least partially on top of and/or at least partially within said receptacle.

17. A liquid dispensing product comprising:

a spray dispenser, said spray dispenser comprising:

a shroud housing a pump, wherein said shroud comprises a shroud top surface, a shroud bottom edge opposing said shroud top surface, and shroud walls connecting the shroud top surface to the shroud bottom edge;

a rotatable nozzle cover housing a discharge nozzle wherein said nozzle cover is rotatable about a central axis thereof, and wherein said discharge nozzle is in fluid communication with said pump;

a trigger operatively engaged with said pump;

a guard proximate said nozzle cover, wherein said guard inhibits contact by an outside structure or force with said nozzle cover from at least one direction and wherein said guard is not in direct contact with said nozzle, wherein said guard is not in direct contact with either said nozzle cover or said trigger; and a liquid composition comprising from about 5% to about 15%, by weight of said composition, of a surfactant system; and wherein said spray dispenser is configured to spray said composition.

18. The liquid dispensing product according to claim 17, wherein said guard extends outwardly from said shroud walls.

* * * * *